US008491346B2

(12) United States Patent
Sjostedt et al.

(10) Patent No.: US 8,491,346 B2
(45) Date of Patent: Jul. 23, 2013

(54) ELECTRICAL CONTACTS USING CANTED COIL SPRINGS AND STAMPED HOUSINGS AND METHODS THEREOF

(75) Inventors: Rob Sjostedt, Foothill Ranch, CA (US); Pete Balsells, Foothill Ranch, CA (US); Kevin Vu, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 22 days.

(21) Appl. No.: 13/105,221

(22) Filed: May 11, 2011

(65) Prior Publication Data

US 2011/0281476 A1 Nov. 17, 2011

Related U.S. Application Data

(60) Provisional application No. 61/334,427, filed on May 13, 2010.

(51) Int. Cl.
*H01R 13/33* (2006.01)

(52) U.S. Cl.
USPC ..... 439/840

(58) Field of Classification Search
USPC .... 439/840, 668, 349, 627, 909, 218; 29/876; 607/37
See application file for complete search history.

(56) References Cited

U.S. PATENT DOCUMENTS

| | | | | |
|---|---|---|---|---|
| 1,691,109 | A * | 11/1928 | Carpenter | 29/11 |
| 6,749,358 | B2 * | 6/2004 | Balsells | 403/316 |
| 6,835,084 | B2 * | 12/2004 | Poon et al. | 439/349 |
| 6,895,276 | B2 * | 5/2005 | Kast et al. | 607/37 |
| 7,164,951 | B2 * | 1/2007 | Ries et al. | 607/37 |
| 7,274,964 | B2 * | 9/2007 | Balsells | 607/37 |
| 7,294,020 | B2 * | 11/2007 | Zhao et al. | 439/627 |
| 8,091,226 | B2 * | 1/2012 | Sjostedt et al. | 29/876 |
| 8,215,013 | B2 * | 7/2012 | Dilmaghanian et al. | 29/876 |
| 2006/0224208 | A1 * | 10/2006 | Naviaux | 607/37 |
| 2009/0095038 | A1 * | 4/2009 | Katagiri | 70/392 |

* cited by examiner

*Primary Examiner* — Alexander Gilman
(74) *Attorney, Agent, or Firm* — Klein, O'Neill & Singh, LLP

(57) ABSTRACT

An electrical contact assembly made from a stamped housing, having a first end with a spring groove housing formed over a canted coil spring in order to provide spring retention to a pin or post inserted into the housing. On the other end of the stamped housing, a wire/cable crimp assembly is formed. The spring, groove housing may be formed having an opening for insertion of the pin or post that is either substantially parallel or perpendicular to the base of the housing.

25 Claims, 8 Drawing Sheets

ELECTRICAL CONTACTS USING CANTED COIL SPRINGS AND STAMPED HOUSINGS AND METHODS THEREOF

CROSS-REFERENCE TO RELATED APPLICATION

This is a regular utility application of provisional application No. 61/334,427, filed May 13, 2010, the contents of which are expressly incorporated herein by reference.

BACKGROUND

Aspects of the disclosed embodiments relate to electrical contacts in various applications, and more particularly to electrical contact assemblies that include a canted coil spring interface in a metal housing that is manufactured in a quick and cost-effective process.

Typical electrical contacts that use a canted coil spring generally have metal housings that are machined from metal rods or tubes. The manufacturing process of machining the housing from a rod or tube is both timely and costly, therefore the end product, which typically reflects the manufacturing cost, results in a relatively expensive unit.

SUMMARY

The present disclosure provides an electrical contact assembly made from a stamped connector body, having a first end with a spring groove housing formed over a canted coil spring in order to provide spring retention to a pin or post inserted into the housing. A wire/cable crimp assembly is formed on the other end of the stamped connector body. The spring groove housing may be formed having an opening for insertion of the pin or post that is either substantially parallel or perpendicular to an axis defined at the base of the connector body.

In another aspect, a plastic housing, sleeve, or jacket may be formed over the electrical contact assembly, such as over part or all of the stamped housing, in order to provide insulation and protection.

The various embodiments of the present process for manufacturing electrical contact assemblies have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description" one will understand how the features of the present embodiments provide advantages, which include reduced complexity of manufacture and assembly, with concomitant cost savings.

In another feature of the present embodiment, a stamped electrical contact assembly is provided. The contact assembly has a first rolled section formed at a first end of a cut-out section and wherein at least a portion of the first rolled section is rolled along a first axis substantially tangent to an outer circumference of the first rolled section and wherein the first rolled section defines an open section and having a groove. The assembly further includes a second rolled section formed at a second end of the cut-out section and wherein at least a portion of the second rolled section is rolled along the first axis substantially tangent to an outer circumference of the second rolled section. The second rolled section coupled to the first rolled section via a bridge section and wherein a canted coil spring is retained in the groove and having a portion of the canted coil spring exposed within the open section.

In a specific feature of the present embodiment, the first rolled section, the bridge section, and the second rolled section are unitarily formed. In other embodiments, the assembly is integrally formed by welding several different pieces together.

The assembly may include a gap separating the first rolled section and exposing at least a portion of the spring that is retained in the groove. The spring can be an axial canted coil spring. In other embodiments, the spring is a radial canted coil spring.

In certain embodiments, the groove can be a V-bottom groove. Alternatively, the groove can have two side walls and a bottom wall located between the two side walls. The side walls may be parallel to one another or at an angle to one another. The bottom wall can be flat, i.e., perpendicular to one of the side walls, or tapered, i.e., angled relative to an axis defined by the open section.

Like the first rolled section, the second rolled section can comprise a gap.

In still yet another feature of the present embodiment, a stamped electrical contact assembly is provided. The assembly comprises a spring groove housing formed at a first end of a cut-out section having a circular body portion defining an open section. A groove is formed by bending a portion of the circular body portion along at least one line segment joining two points on a curve on the circumference of the circular section. A crimp assembly for retaining a cable or wire is formed at a second end of the cut-out section and coupled to the spring groove housing via a bridge section. A canted coil spring is retained in the groove and having a portion of the canted coil spring exposed within the open section.

In one example, the circular body portion comprises one or more cut sections to enable bending at least along two line segments.

The open section can define an axis that is generally perpendicular to an axis defined by the bridge section.

The groove can comprise at least two different groove configurations formed along the first end. For example, one groove section can have a V-shape configuration while the other section of the groove can have a straight wall with a single tapered wall, like a modified V-shape with one of the walls being generally straight, i.e., non-tapered.

A gap may be included at the second end, which defines a line that is generally perpendicular to an axis defined by the open section.

A further feature of the present embodiment is a method for making a stamped electrical contact assembly. The method comprises the steps of stamping a blank to create a preformed shape, forming a first rolled section at a first end of the preformed shape by rolling at least a portion of the preformed shape, the first rolled section defining an open section and a groove, and forming a second rolled section at a second end of the preformed shaped by rolling at least a portion of the second rolled section, the second rolled section coupled to the first rolled section by a bridge section. The method further comprising retaining a canted coil spring in the groove so that at least a portion of the canted coil spring is exposed within the open section. In one example, the first rolled section is rolled along an outer axis and the second section is rolled along the same outer axis.

The method further can comprise placing a cable at the second end before forming the second rolled section.

The first rolled section can comprise at least one cut section to enable folding at least two adjacent sections of the first rolled section.

In any of the described embodiments, the spring can be made from a multi-metallic wire. The wire can include a highly conductive inner core with a less conductive but higher tensile strength outer layer. For example, the wire can include a copper or copper alloy inner core with a stainless steel outer layer. Alternative, the metallurgy can reverse with the more conductive material on the outside.

BRIEF DESCRIPTION OF THE DRAWINGS

The various embodiments of the present electrical contact assembly will be discussed in detail with an emphasis on highlighting the advantageous features. These embodiments depict the novel and non-obvious electrical contact assembly shown in the accompanying drawings, which are for illustrative purposes only. These drawings include the following figures, in which like numerals indicate like parts.

DETAILED DESCRIPTION

Figure 1A:
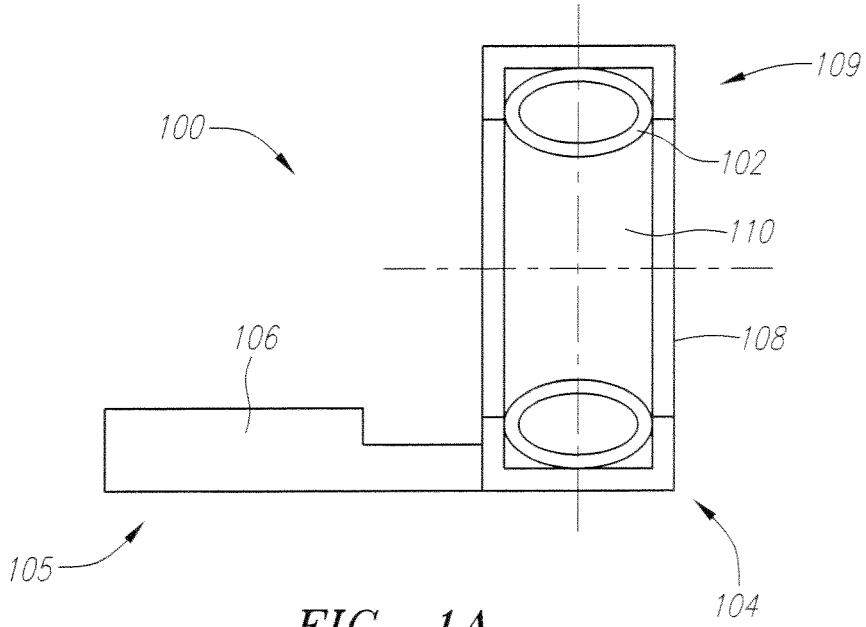
FIG. 1*a* shows a simplified cross-sectional view of an electrical contact assembly with a canted coil spring and a metal housing for connection in accordance with an embodiment.

The following detailed description describes the present embodiments with reference to the drawings. In the drawings, reference numbers label elements of the present embodiments. These reference numbers are reproduced below in connection with the discussion of the corresponding drawing features.

Metal stamping manufacturing is the process of creating metal parts by applying relatively high pressure to a blank piece of metal and pressing the blank into a desired shape, typically of the cutter used to press against the blank piece. The stamping machine incorporates a specially made form or die that gives the stamped part shape. The metal stamping manufacturing process is capable of high production manufacturing. Although typical stamping speeds do vary, many high production stamping manufacturers are capable of 30 to 80 stamping strokes per minute. Due to the extremely quick manufacturing process of each part, the cost-per-part may be significantly reduced, depending on the complexity of the part.

FIG. 1*a* shows a simplified cross sectional view of an electrical contact assembly 100 having a canted coil spring 102 housed within a connector body 104 in accordance with an embodiment. The canted coil spring 102 may have a curvilinear shape, such as a garter shape, provided by connecting the opposing ends of the canted coil spring 102. The canted coil spring 102 may be radial, axial, or positioned at a turn angle. The canted coil spring 102 may be made of any metal alloy or any conductive material known in the art, and may be made of a bimetallic or a multi-metallic spring wire. For example, the spring may a multi-metallic as disclosed in, for example, co-pending application Ser. No. 12/767,421, entitled Multilayered Canted Coil Springs and Associated Methods, filed Apr. 26, 2010, the contents of which are expressly incorporated herein by reference.

Figure 1B:
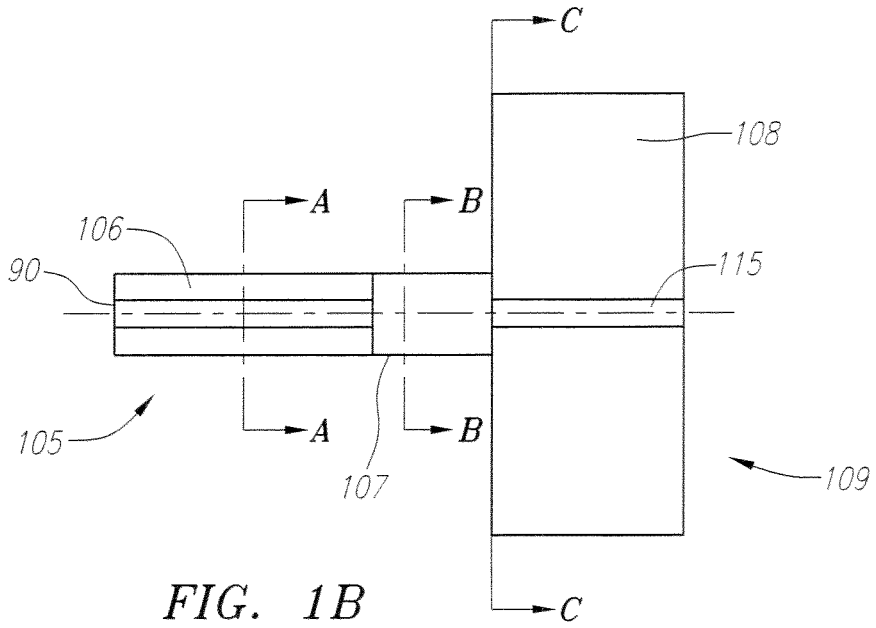
FIG. 1*b* shows a simplified top view of the metal housing shown in FIG. 1*a* in accordance with an embodiment.

As described in detail below, the connector body 104 may be a metal stamped body, which may be made of a conductive metal, such as a copper, aluminum, steel, and combinations and alloys thereof, or the connector body 104 may be plated. Referring to FIG. 1*b*, the connector body 104 includes a cable/wire crimp assembly 106 formed at a first end 105, a spring groove housing 108, formed at a second end 109, and an intermediary section or bridge section 107 formed therebetween. After rolling the first end 105, a gap or slot 90 remains, which has two edges defined by the stamped material used in the rolling process.

Figure 1C:
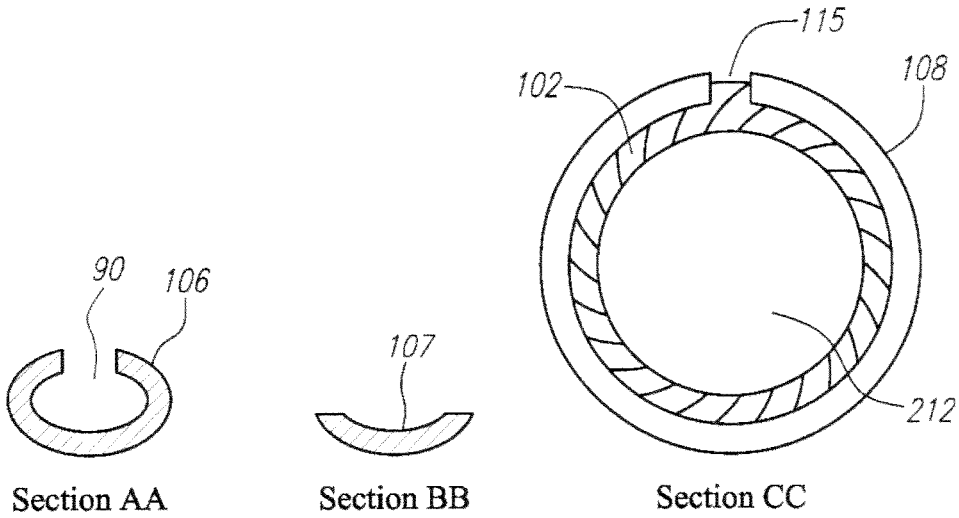
FIG. 1*c* shows simplified cut outs of cross-sectional views AA, BB, and CC from the electrical contact assembly of FIG. 1*b* in accordance with an embodiment.

The spring groove housing 108 is sized, shaped and otherwise configured to retain the canted coil spring 102 (FIG. 1*a*). The bridge section 107 connects the wire crimp assembly 106 to the spring groove housing 108. FIG. 1*c* shows a cut-out of cross sections of the crimp assembly 106 (section AA), the bridge section 107 (section BB), and the spring groove housing 108 having the canted coil spring 102 disposed therein (section CC) in accordance with an embodiment.

Referring again to FIG. 1*a*, in one embodiment, the spring groove housing 108 includes a groove or channel 110 formed therein. The groove 110 is shaped and sized to receive the canted coil spring 102 and retain at least a portion of the spring. In one embodiment, the groove 110 retains the canted coil spring 102 such that the groove 110 retains at least the outer portion of the canted coil spring 102, thus exposing the other portion of the canted coil spring to allow the spring to capture a pin or post that is coupled to the electrical contact assembly 100. In one example, the groove captures about half of the outer portion of the spring and allowing the other portion of the outer spring to be exposed. The groove 110 may be a simple groove having a flat bottom wall and two sidewalls that are substantially orthogonal to the bottom wall. In other embodiments, the bottom wall is shaped or formed at an angle relative to the sidewalls to cause the spring to sit in the groove at a certain desired turn angle.

Figure 2A:
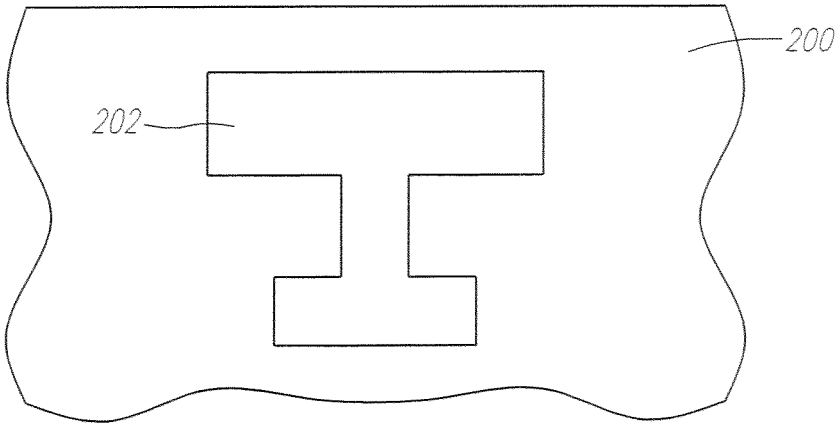
FIGS. 2*a*, 2*b* and 2*c* are simplified views of a manufacturing process for the electrical contact assembly in accordance with an embodiment.
Figure 2B:
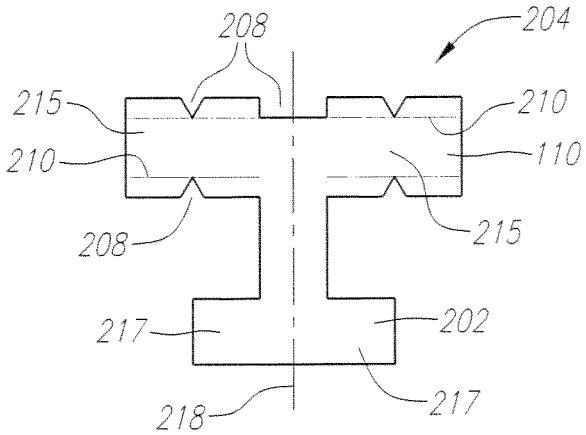

In one embodiment, as shown in FIG. 2*a*, to form the electrical contact assembly 100, a piece of sheet metal 200 may be stamped to create at least one to a plurality of singularly formed blanks 202. The stamping process creates blanks in preformed shape 204 suitable for forming the contact assembly 100 as a unitary structure. In other embodiments, multiple stamping steps may be used to cut specific cut sections or create fold lines after a rough configuration is stamped from a first stamping step. For example, as shown in FIG. 2*b*, the preformed shape 204 of the sheet metal is stamped into a T-shape that includes a first set of arms 215 and a second set of arms 217 formed substantially symmetric about an axis 218. The axis 218 is defined along a centerline of the base of the connector body. The preformed shape 204 may also include a predetermined set of cut sections and fold lines, such as, for example, cut sections 208 and fold lines 210 shown in FIG. 2*b*. The first set of arms 215, the second set of arms 217, the cut sections 208 and the fold lines 210 may vary in number, size and location depending on the application and desired final shape of the assembly 100. In one embodiment, the cut sections 208 and fold lines 210 are positioned to allow for the folding or bending of at least a portion of the preformed shape 204, which forms sidewalls 219 (FIG. 2*c*) of the groove 110. Unless the context indicates otherwise, folding, bending and/or rolling in the context of shaping a cut-out blank of the instant embodiment to form a refined or modified cut-out portion or blank are intended to mean the same. In other embodiments, several separately formed blanks are cut, rolled, and welded together to form a completed connector assembly. Preferably, the number of separately formed blanks per apparatus is reduced to minimize the number of welds. More preferably, the blank is singularly formed so that the apparatus does not require any welding.

Figure 2C:
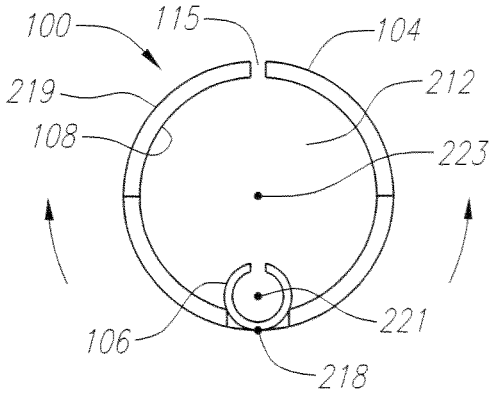

As shown in FIG. 2*c*, after the sidewalls 219 are created, the preformed shape 204 may be rolled such that the rolling of the preformed shape rolls the second set of arms 217 to create a substantially cylindrical portion (Section AA, FIG. 1*c*), which forms the crimp assembly 106. The second set of arms 217 are rolled along axis 218, such that the axis 218 becomes substantially tangent to the outer circumference of the cylindrical portion of the crimp assembly 106. The axis 218 may also be substantially parallel to a central axis 221 of the crimp assembly. The crimp assembly 106 formed by the rolling process includes the at least one crimpable cylindrical section having a first diameter, which allows for engagement between the connector body 104 and at least one wire, cable or multiple strands of wires or cables.

The rolling of the preformed shape 204 also rolls the first set of arms 215 into a substantially cylindrical portion (Section CC, FIG. 1*c*) having a second diameter that is larger than the first diameter of the crimp assembly 106. The two rolled sections may also be viewed as two rolled sections of different diameters disposed along the same general orientation. The larger cylindrical portion forms the spring groove housing 108 while the relatively smaller portion forms the wire crimp section. The first set of arms 215 are rolled along axis 218, such that the axis 218 becomes substantially tangent to the outer circumference and substantially parallel to a central axis 223 (FIGS. 2*c* and 2*d*) of an open section of the cylindrical portion of the spring groove housing 108. When rolled, the sidewalls 219 (FIG. 2*c*) formed on the first set of arms 215 of the preformed shape 204 create the groove 110. In this position, the groove 110 may be used for housing the canted coil spring 102 to ensure that the canted coil spring 102 may be retained within the housing. In one embodiment, at least a portion of the canted coil spring 102 may be positioned between the sidewalls 219 and within the groove 110 prior to, and while the preformed shape 204 is rolled into the final position. Preferably, however, the spring is positioned inside the groove following the rolling step to form the housing.

As shown in FIG. 2*c*, the rolling of the first set of arms 215 also creates an open section 212 defined by the spring groove housing 108. The open section 212 is configured as a female terminal for engagement to a male pin or post 214 (FIG. 2*c*). As shown in FIG. 2*c*, the groove 110 for containing the canted coil spring 102 is positioned about the open section 212. In this position, at least a portion of the canted coil spring 102 is exposed within the open section 212 and thus provides for electrical communication between the male pin 214 and the female terminal. In another embodiment, the pin or post 214 comprises a groove (not shown) for capturing part of the spring.

In summary, the stamped electrical contact assembly 100 includes a first rolled section or the spring groove housing 108 formed at a first end of the connector body 104 by rolling at least a portion of the assembly along the axis 218 defined along the base of the connector body 104. The first rolled section has a first diameter. After being rolled, the axis 218 is substantially tangent to an outer circumference of the first rolled section. The first rolled section defines the open section 212 and also includes the groove 110. The second rolled section or crimp assembly 106 is formed at the second end of the assembly by rolling at least a portion of the assembly along the same axis 218 as the first rolled section. Thus, the axis 218 is substantially tangent to an outer circumference of the second rolled section as well. The second rolled section has a second diameter that is smaller than the first diameter. The second rolled section is coupled to the first rolled section via the bridge section 107. The canted coil spring 102 is retained in the groove 100 such that at least a portion of the canted coil spring 102 is retained in the groove 110 and at least another portion of the canted coil spring 102 is exposed within the open section.

Advantageously, since both the first set of arms 215 and the second set of arms 217 are rolled along the same axis 218, the rolling of the preformed shape 204 may simultaneously create both the crimp assembly 106 and the spring groove housing 108. In some embodiments, the crimp assembly 106 and the spring groove housing 108 may be created separately, such as rolled in sequential steps or when separately formed and subsequently welded together. Some electrical contact assemblies are manufactured by bending, folding or rolling portions of the assembly about multiple axes to create the connector body. However, creating the crimp assembly 106 and the spring groove housing 108 by rolling the preformed shape 204 along the same axis 218 as described above simplifies the manufacturing process by reducing the amount of manipulation of the preformed shape 204 that is needed.

Small tolerances between the engagement of the canted coil spring 102 and the male pin 214 may be accommodated by adjusting the diameter of the open section 212 by either stretching or compressing the spring groove housing 108 to increase or decrease the size of gap 115 (FIG. 1*c*). Otherwise, the open section 212 of the spring groove housing 108 may be sized and shaped to any desired diameter by varying the size and shape of the first set of arms 215 of the preformed shape 204 prior to rolling. Additionally, the canted coil spring has an operating range, known as a generally constant force over a range of deflection. As such, the rolled housing may be formed with acceptable tolerance and not have to be specific to a pin. In fact, due to the operating range of a canted coil spring, the same rolled housing may be used for a range of pins having a variation in pin diameters.

Figure 2D:
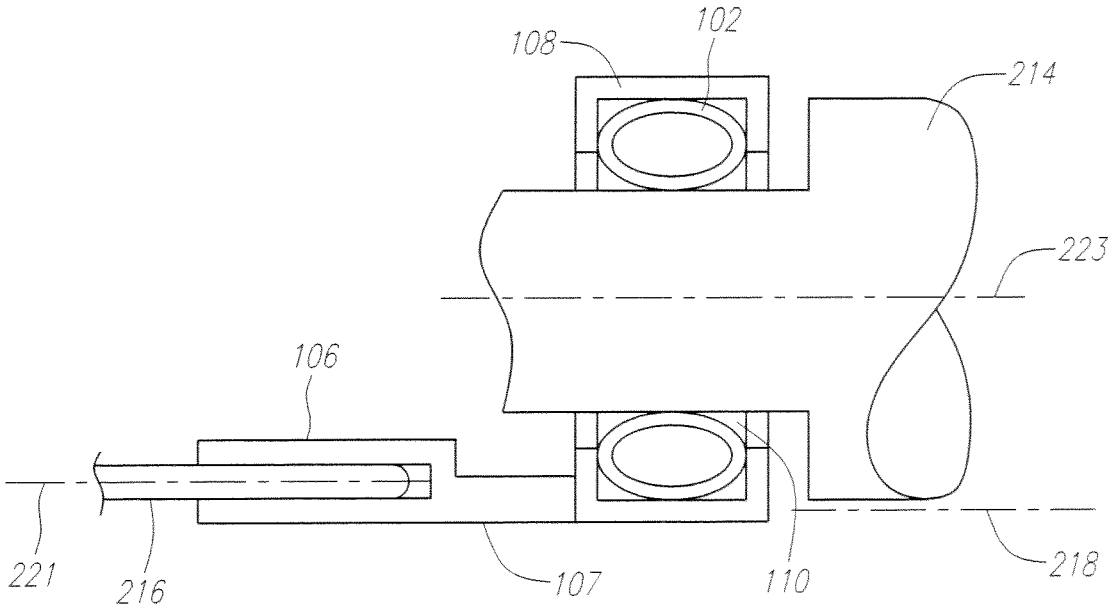
FIG. 2*d* is a simplified cross-sectional view of the electrical contact assembly with a mating pin inserted in a direction relative to the base of the metal housing in accordance with an embodiment.

FIG. 2*d* shows a simplified cross sectional view of the electrical contact assembly 100 for an in-line connection with the mating pin 214 inserted in the open section 212 in accordance with an embodiment. As used herein, in-line connection is understood to mean features of the electrical contact assembly 100 that allows it to receive the pin 214 with its central axis parallel, albeit offset, from the axis 218 defined along the base of the connector body. However, the electrical contact assembly 100 is capable of other configurations for receiving the pin 214 and the term is used to merely distinguish by name or reference from other contact assemblies discussed herein only. As shown, a wire or cable 216 may be crimped into the crimp assembly 106 to complete an electrical connection with the male pin 214, via the connector body 104 and the canted coil spring 102.

Figure 3A:
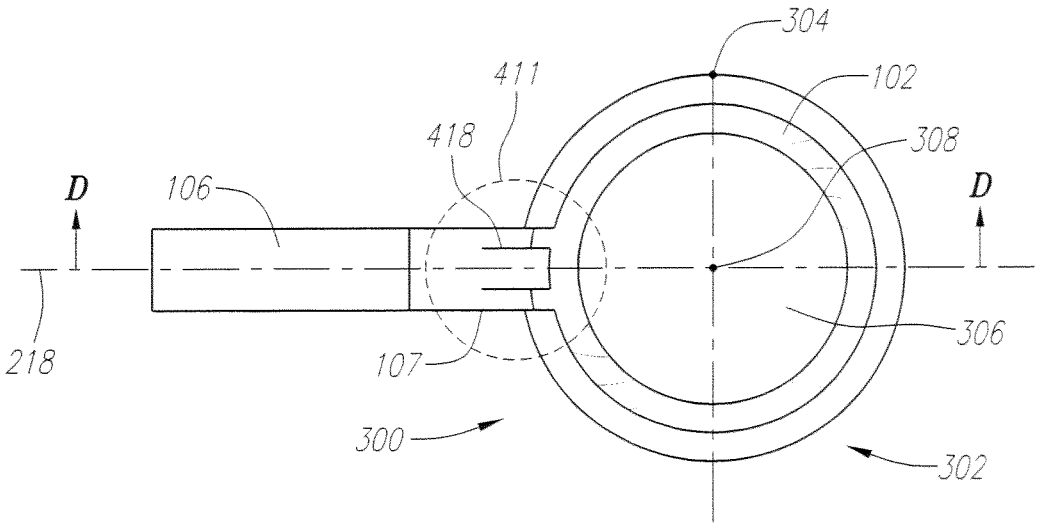
FIGS. 3*a* and 3*b* are simplified cross-sectional views of an electrical contact assembly with a canted coil spring and a metal housing for connection in accordance with an embodiment.
Figure 3B:
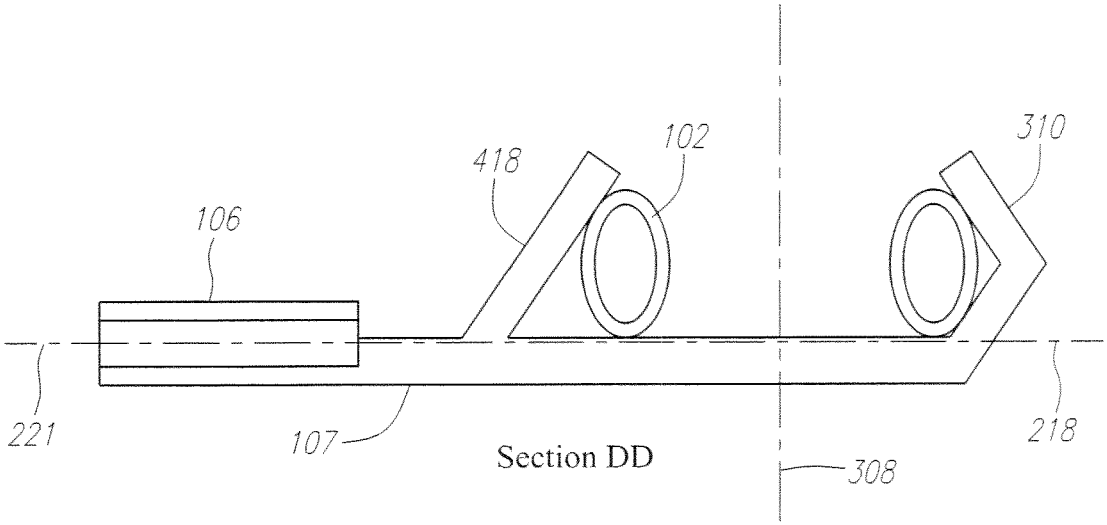

FIGS. 3*a* and 3*b* show simplified cross-sectional views of an electrical contact assembly 300 with a canted coil spring 102 and a metal connector body 302 that may be used for creating a perpendicular connection (not in-line) to a pin or post in accordance with another embodiment. As used here, perpendicular connection is understood to mean that the electrical contact assembly 300 is capable of receiving a pin, which has its central axis perpendicular to the axis 218 of the connector body 302 (see FIG. 4*d*). However, the term merely serves to distinguish the instant embodiment from other embodiments discussed elsewhere herein and direction of insertion or coupling to a mating pin can vary, not limited to a perpendicular connection. In this embodiment, the metal connector body 302 includes the crimp assembly 106 the bridge section 107 and a spring groove housing 304, which defines an open section 306 that has a central axis 308 perpendicular to the axis 218 of the base of the housing 302. The open section 306 is configured as a female terminal for engagement to a male pin or post (FIG. 4*d*).

As shown in FIG. 3*b*, a groove 310 for containing the canted coil spring 102 is formed and positioned about an outer circumference of the spring groove housing 304. The groove 310 is shaped and sized to receive the canted coil spring 102. The groove 310 may have different cross-sectional configurations formed along different parts of the assembly. As shown, the right side of the groove is generally V-shaped where as the left side for the groove is generally straight with a single slanted wall.

In one embodiment, groove 310 retains the canted coil spring 102 such that the groove 310 retains at least an outer portion of the canted coil spring 102. Thus, the other portion of the spring is exposed within the open section 306 to allow the spring to capture the pin or post that is coupled to the electrical contact assembly 300. The spring is configured to provide electrical communication between the pill and the female terminal. In other embodiments, the groove captures more than or less than half of the spring so that the remaining part of the spring is exposed for receiving the pin. The assembly 300 may be used in a holding application as shown in FIG. 4*d* or in a latching or locking application by incorporating a groove around the exterior surface of the pin. The pin groove may include two sidewalls and a bottom wall located therebetween. The two side walls may be generally parallel to one another or angled to one another. The bottom wall may be generally square to both side walls or to only one side wall. The pin groove may be structured to allow locking when moving the pin in one direction and unlocking when moving the pin in the opposite direction.

Figure 4A:
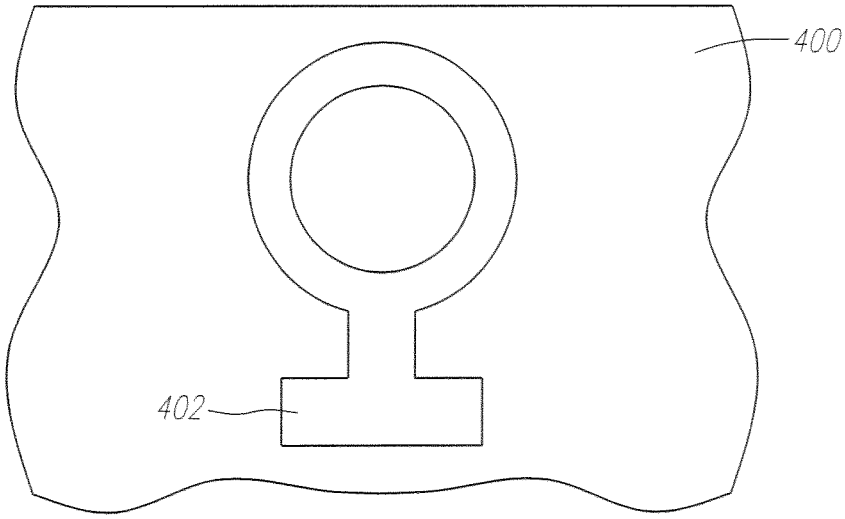
FIGS. 4*a*, 4*b* and 4*c* are simplified views of a manufacturing process for the electrical contact assembly in accordance with an embodiment.
Figure 4B:
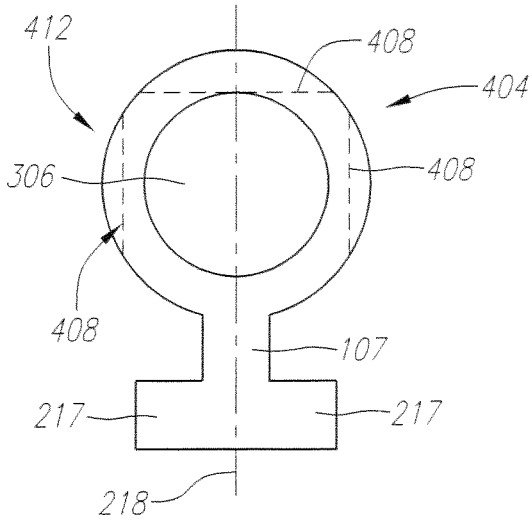

In one embodiment, as shown in FIG. 4*a*, to born the electrical contact assembly 300, a piece of sheet metal 400 may be stamped to create at least one to a plurality of blanks 402. The blanks 402 may include a preformed shape 404 suitable for forming the contact assembly 300 (FIG. 3*a*). In one example, as shown in FIG. 4*b*, the preformed shape 404 of the sheet metal is stamped to include a second set of arms 217. The arms 217 are formed symmetrically about the axis 218 and are coupled to a substantially circular section 412 via the bridge section 107. The circular section 412 comprises an open section 306 or cut-out formed by punching, cutting or stamping a section of the circular section 412.

Figure 4C:
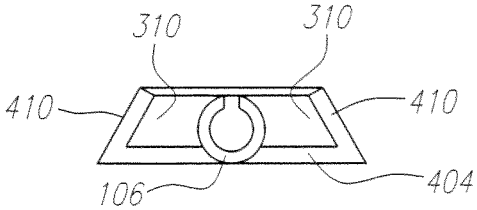
Figure 4D:
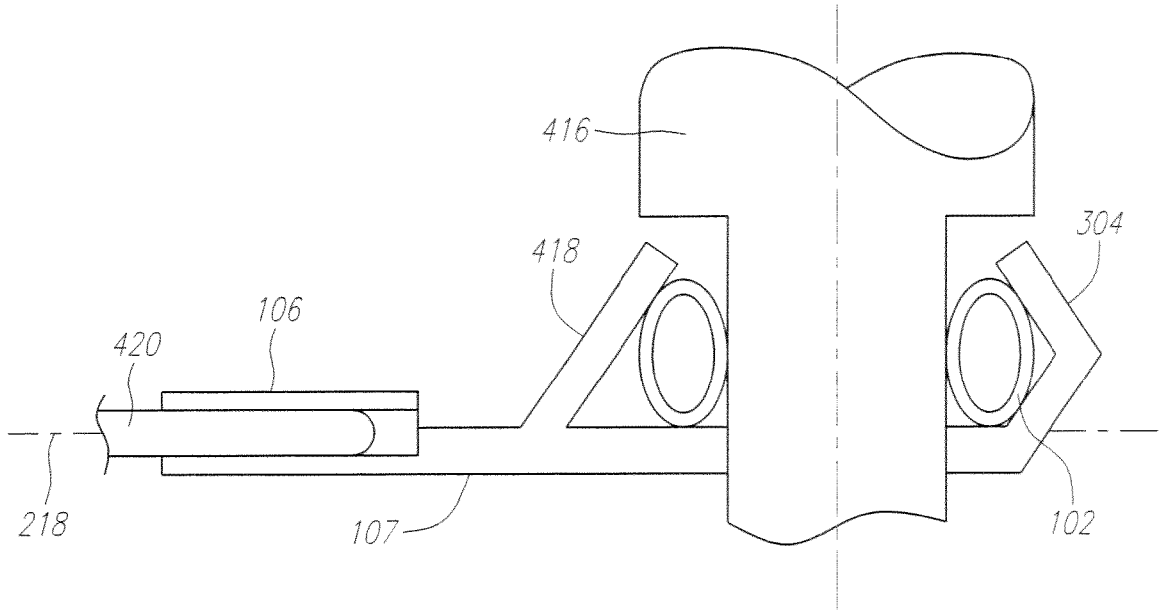
FIG. 4*d* is a simplified cross-sectional view of the electrical contact assembly with a mating pin inserted in the metal housing in accordance with an embodiment.

As shown in FIG. 4*c*, a portion of the preformed shape 404 including the second set of arms 217 is rolled to create the at least one crimpable cylindrical section (Section AA, FIG. 1*c*). The crimpable section forms a crimp assembly 106 and provides for engagement between the spring groove housing 304 and at least one wire or cable or a plurality of strands or wires.

The circular section 412 of the preformed shape 404 may have, fold lines, such as fold lines 408 at predetermined locations. The fold lines 408 allow for the folding, bending or rolling of at least a portion of the circular section 412 of the preformed shape 404 to form sidewalls 410 of the groove 310. The sidewalls 410 capture at least a portion of the canted coil spring 102. Fold lines may be added using conventional means, such as pressing against the blanks to create creases. The die for cutting the blank 402 may also be equipped with edges near the cutting edges to create weakened or deformed areas for folding the blank into a desired final shape.

In one embodiment, the fold lines 408 may embody a plurality of chords, which are straight line segments joining two points on a curve or arc on the circumference of the circular section 412. In other embodiments, only a single chord is incorporated. The portions of the circular section 412 outboard of the chord fold lines 408 may be rolled, bent or folded along the fold lines 408 toward the open section 306. Thus, there may be at least one to a plurality of sidewalls 410 created along the at least one to plurality of chords for capturing and retaining the canted coil spring 102. In one embodiment, the canted coil spring 102 may be positioned on the preformed shape 404 while the preformed shape 404 is being rolled and folded into the final position. More preferably, the spring is positioned in the groove of the housing after the folds and walls have been folded.

Referring again to FIG. 3*a*, in one embodiment, an area 411 of the spring groove housing 304 that meets and couples the bridge section 107 of the connector body 302 may be devoid of any sidewall 410. Thus, the spring would be exposed, i.e., would not have any sidewall, at or near area 411. The sidewall 410 may be eliminated at the area 411 due to the connection between the spring groove housing 304 and the bridge section 107. In one embodiment, a tab 418 may be formed by punching through a portion of the bridge section 107 and folding it to form a standalone sidewall at the bridge, forming a portion of the spring groove housing 304. The tab 418 may be lifted and used to retain a portion of the canted coil spring 102 in the area 411 of the bridge, in essence, providing a sidewall for the groove 310 at the bridge section.

FIG. 4*d* shows a simplified cross sectional view of the electrical contact assembly 300 with a mating pin 416 inserted in the open section 306 in a perpendicular direction relative to the axis 218 of the base of the connector body 302 of the electrical contact assembly housing 300. This creates a perpendicular connection in accordance with the embodiment. As shown a wire or cable 420 may be crimped into the crimp assembly 106 to complete an electrical connection with the male pin 416, via the connector body 302 and the canted coil spring 102. The pin may be a plug or a node, such as a post on a battery terminal.

In summary, the stamped electrical contact assembly 300 includes a spring groove housing 304 formed at a first end of the assembly having a circular section 412 defining an open section 306, and at least a portion of a groove 310 formed by bending, rolling or folding a portion of the circular section 412 along at least one line segment joining two points on a curve on the circumference of the circular section. The crimp assembly 106 is formed at a second end of the assembly 300 and coupled to the spring groove housing 304 via the bridge section 107. The canted coil spring 102 is retained in the groove 310 such that at least a portion of the canted coil spring 102 is retained in the groove and at least another portion of the canted coil spring 102 is exposed within the open section 306.

Although shown in the embodiments above as having either an in-line or a perpendicular connection capability, it should be understood that the electrical contact assemblies might also be formed to have offset connections. The offset connection capability includes connection capability that is between the perpendicular and parallel connection capability by incorporating further fold lines, offset lines, etc.

In addition, the electrical contact assemblies described above may include multiple spring groove housings for accommodating multiple canted coil springs. Such embodiment may be incorporated to receive multiple pins in a multi-pin connector application.

Figure 5:
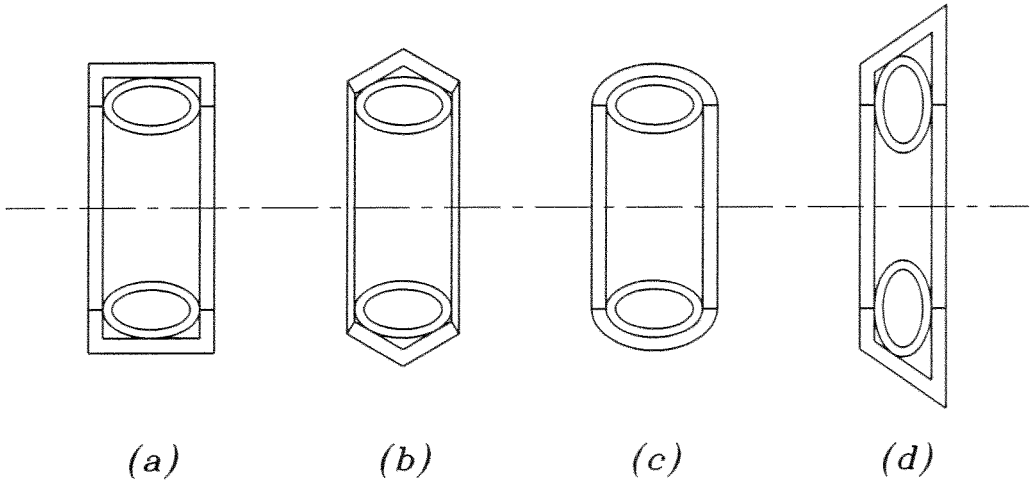
FIGS. 5*a*, 5*b*, 5*c* and 5*d* are simplified views of various groove shapes for use with the spring groove housing in accordance with an embodiment.

FIGS. 5*a*, 5*b*, 5*c* and 5*d* are simplified views of various groove shapes that may be incorporated in the spring groove housings. FIGS. 5*a*, 5*b* and 5*c* illustrate a flat-bottom groove, a V-bottom groove and a U-bottom groove, respectively. In one embodiment, the flat, V-bottom and U-bottom grooves may be used for retaining a radial canted coil spring. FIG. 5*d* illustrates a tapered-bottom groove, which may be used for retaining an axial canted coil spring. In this embodiment, by using an axial canted coil spring, the ratio of insertion force to removal force may be controlled. Thus, the force to insert and remove the pin or post into or from the spring groove housing may be controlled. In the embodiment of FIG. 5*a*, the spring contacts the bottom groove and the two sidewalls. Alternatively, the spring, contacts the bottom wall and only one of the sidewalls. In FIG. 5*b*, the spring contacts both walls or surfaces of the V-bottom groove. In FIG. 5*c*, the spring may contact two or more points of the U-bottom groove. In FIG. 5*d*, the spring is biased against the two side walls and contacts the bottom wall.

Figure 6:
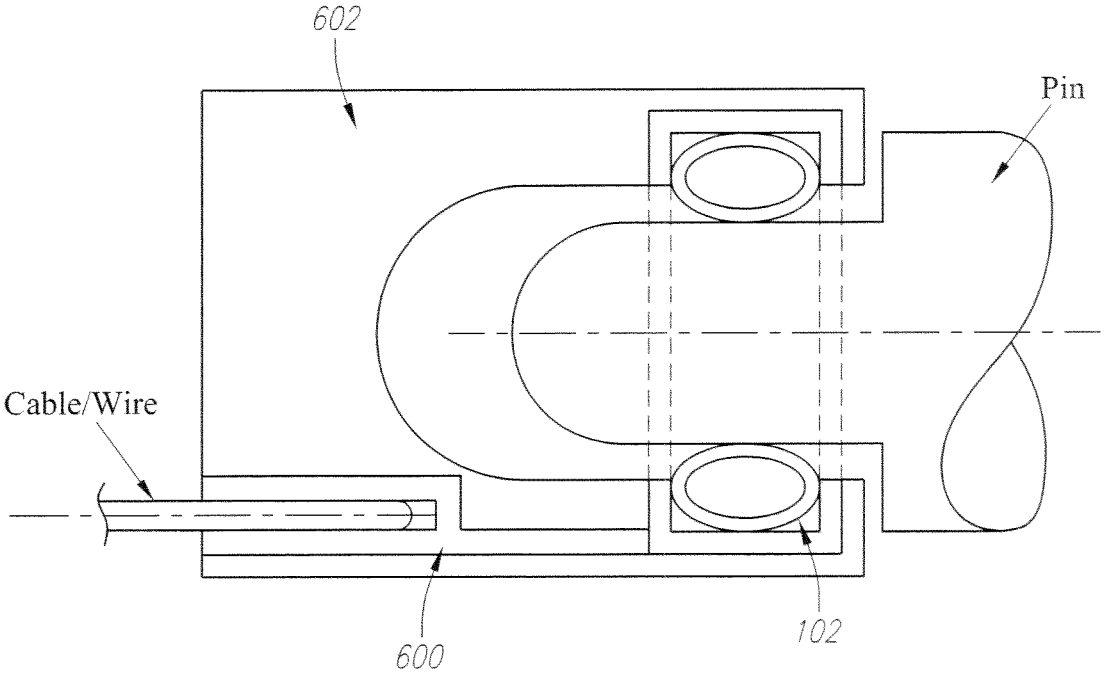
FIG. 6 is a simplified illustration of an electrical contact assembly including a plastic housing in accordance with an embodiment.

FIG. 6 shows an electrical contact assembly 600 that includes a non-conductive plastic outer housing 602 positioned over at least a portion of the electrical contact assembly provided in accordance with an embodiment. The plastic outer housing 602 may serve as an insulator or for protection of the contact assembly 600. The plastic outer housing 602 may be made using known methods, such as injection molding, compression molding, extrusion molding or others.

The above description presents the best mode contemplated for the electrical contact assemblies, in such full, clear, concise, and exact terms as to enable any person skilled in the art to which it pertains to make and use the assemblies. The assemblies, however, are susceptible to modifications and alternate constructions from that discussed above that are equivalent. Consequently, the electrical contact assemblies are not limited to the particular embodiments disclosed. On the contrary, the disclosure covers all modifications and alternate constructions coming within the spirit and scope of the disclosure as generally expressed by the following claims, which particularly point out and distinctly claim the subject matter of the disclosure. Also, while specific features may be discussed with certain figures or embodiments of the present application, they may be incorporated in other figures or embodiments not expressly discussed provided they functions or features do not conflict.

What is claimed is:

1. A stamped electrical contact assembly comprising:

a first rolled section formed at a first end of a cut-out section; wherein at least a portion of the first rolled section is rolled along a first axis substantially tangent to an outer circumference of the first rolled section, the first rolled section defining an open section and an outer edge of the cut-out section defining, at least in part, an outer edge of a groove;

a second rolled section formed at a second end of the cut-out section; wherein at least a portion of the second rolled section is rolled along the first axis substantially tangent to an outer circumference of the second rolled section, the second rolled section coupled to the first rolled section via a bridge section; and a canted coil spring retained in the groove and having a portion of the canted coil spring exposed within the open section.

2. The stamped electrical contact assembly of claim 1, wherein the first rolled section, the bridge section, and the second rolled section are unitarily formed.

3. The stamped electrical contact assembly of claim 1, further comprising a gap separating the first rolled section and exposing at least a portion of the spring that is retained in the groove.

4. The stamped electrical contact assembly of claim 1, wherein the spring is an axial canted coil spring.

5. The stamped electrical contact assembly of claim 1, wherein the groove is a V-bottom groove.

6. The stamped electrical contact assembly of claim 1, wherein the second rolled section comprises a gap.

7. A stamped electrical contact assembly comprising:

a spring groove housing formed at a first end of a cut-out section having a body portion with an outer circumference and an open section located internally of the outer circumference, a groove formed by bending a portion of the body portion along at least one line segment joining two points on a curve on the outer circumference of the body portion so that an outer edge of the cut-out section define, at least in part, an outer edge of the groove;

a crimp assembly formed at a second end of the cut-out section and coupled to the spring groove housing via a bridge section; and a canted coil spring retained in the groove and having a portion of the canted coil spring exposed within the open section.

8. The stamped electrical contact assembly of claim 7, wherein the body portion is generally circular and comprises one or more cut sections to enable bending at least along two line segments.

9. The stamped electrical contact assembly of claim 7, wherein the open section defines an axis that is generally perpendicular to an axis defined by the bridge section.

10. The stamped electrical contact assembly of claim 7, wherein the groove comprises at least two different groove configurations formed along the first end.

11. The stamped electrical contact assembly of claim 7, further comprising a gap formed at the second end, which defines a line that is generally perpendicular to an axis defined by the open section.

12. A method of making a stamped electrical contact assembly comprising:

stamping a blank to create a preformed shape;

forming a first rolled section at a first end of the preformed shape comprising an outer edge by rolling at least a portion of the preformed shape, the first rolled section defining an open section and the outer edge of the preformed shape defining, at least in part, an outer edge of a groove;

forming a second rolled section at a second end of the preformed shaped comprising an outer edge by rolling at least a portion of the second rolled section so that the outer edge of the second rolled section forms part of a slit, the second rolled section coupled to the first rolled section by a bridge section; and retaining a canted coil spring in the groove so that at least a portion of the canted coil spring is exposed within the open section.

13. The method of claim 12, further comprising placing a cable at the second end before forming the second rolled section.

14. The method of claim 12, wherein the first rolled section is rolled along an outer axis and the second section is rolled along the outer axis.

15. The method of claim 12, wherein the first rolled section comprises at least one cut section to enable folding at least two adjacent sections of the first rolled section.

16. The method of claim 12, wherein the spring is made from a multi-metallic wire.

17. The stamped electrical contact assembly of claim 1, further comprising one or more cut sections formed along outer edges of the cut-out section to facilitate rolling.

18. The stamped electrical contact assembly of claim 1, wherein the first rolled section defines a first centerline and the second rolled section defines a second centerline, and wherein the first centerline and the second centerline are generally parallel and offset from one another.

19. The stamped electrical contact assembly of claim 7, wherein the open section defines a first centerline and the crimp assembly defines a second centerline, and wherein the first centerline is generally orthogonal to the second centerline.

20. The method of claim 12, wherein the canted coil spring is a radial canted coil spring.

21. A stamped electrical contact assembly comprising:

a cut-out section having a planar wall surface comprising a first end having an outer perimeter and an opening located interiorly of the outer perimeter;

a spring groove located around the opening and formed at least in part from a contiguous section of the first end of the planar wall surface, said spring groove comprising a bent section located between a groove bottom and a groove side wall;

a crimp assembly formed at a second end of the planar wall surface and coupled to the first end via a bridge section; and a canted coil spring retained in the spring groove and having a portion of the canted coil spring exposed within the opening of the planar wall surface;

wherein the opening of the first end is configured to receive a pin.

22. The stamped electrical contact assembly of claim 21, wherein the first end of the planar wall surface and the second end of the planar wall surface are of differing sizes.

23. The stamped electrical contact assembly of claim 21, wherein an outer edge of the cut-out section defines, at least in part, an outer edge of the spring groove.

24. The stamped electrical contact assembly of claim 21, wherein the bridge section is directly connected to the groove bottom of the spring groove.

25. The stamped electrical contact assembly of claim 21, wherein the spring groove comprises at least two different configurations of the spring groove bottom and the spring groove wall along a circumference.

* * * * *

UNITED STATES PATENT AND TRADEMARK OFFICE

CERTIFICATE OF CORRECTION

PATENT NO. : 8,491,346 B2
APPLICATION NO. : 13/105221
DATED : July 23, 2013
INVENTOR(S) : Rob Sjostedt et al.

It is certified that error appears in the above-identified patent and that said Letters Patent is hereby corrected as shown below:

On Title page, item (57), under "ABSTRACT", in column 2, line 6, Delete "spring," and insert -- spring --, therefor.

In the Specification

In column 5, line 65, Delete "(FIG. 2c)." and insert -- (FIG. 2d). --, therefor

In column 7, line 17, Delete "vary," and insert -- vary, i.e., --, therefor.

In column 7, line 19, Delete "106" and insert -- 106, --, therefor.

In column 7, line 34, Delete "groove" and insert -- the groove --, therefor.

In column 7, line 40, Delete "pill" and insert -- pin --, therefor.

In column 7, line 54, Delete "born" and insert -- form --, therefor.

In column 9, line 28, Delete "spring," and insert -- spring --, therefor.

Signed and Sealed this
Twelfth Day of August, 2014

Michelle K. Lee

Michelle K. Lee
*Deputy Director of the United States Patent and Trademark Office*